US008324985B2

(12) United States Patent
Chang et al.

(10) Patent No.: US 8,324,985 B2
(45) Date of Patent: Dec. 4, 2012

(54) ISOLATED DUAL-MODE CONVERTER AND APPLICATIONS THEREOF

(75) Inventors: Tsun-Hsu Chang, Hsinchu (TW); Nai-Ching Chen, Hsinchu (TW); Chun-Tan Wu, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 246 days.

(21) Appl. No.: 12/822,446

(22) Filed: Jun. 24, 2010

(65) Prior Publication Data

US 2011/0221545 A1 Sep. 15, 2011

(30) Foreign Application Priority Data

Mar. 12, 2010 (TW) ..... 99107265 A

(51) Int. Cl.
*H01P 5/12* (2006.01)
*H01P 1/161* (2006.01)

(52) U.S. Cl. ..... 333/137; 333/135; 333/21 A; 333/122

(58) Field of Classification Search ..... 333/21 R, 333/21 A, 122, 135, 137
See application file for complete search history.

(56) References Cited

U.S. PATENT DOCUMENTS 2,619,539 A * 11/1952 Fano ..... 333/21 R
2,730,677 A * 1/1956 Boissinot et al. ..... 333/21 R
2,800,632 A * 7/1957 Walker ..... 333/21 R
4,420,756 A * 12/1983 Hamada et al. ..... 342/153
4,504,805 A * 3/1985 Ekelman et al. ..... 333/126
5,525,864 A * 6/1996 Butler et al. ..... 315/3.6
7,369,011 B2 * 5/2008 Chang et al. ..... 333/125
7,394,335 B2 * 7/2008 Chang et al. ..... 333/137
7,973,613 B2 * 7/2011 Chang et al. ..... 333/21 R

* cited by examiner

*Primary Examiner* — Robert Pascal
*Assistant Examiner* — Kimberly Glenn
(74) *Attorney, Agent, or Firm* — Muncy, Geissler, Olds & Lowe, PLLC

(57) ABSTRACT

An isolated dual-mode converter includes a $TE_{01}$ mode converter including a circular waveguide, and a plurality of rectangular waveguides connected to the circumference of the circular waveguide; and a $TM_{01}$ mode converter including a coaxial waveguide, formed by coaxial outer and inner conductors, and the circular waveguide connected and aligned axially with the coaxial waveguide, wherein a symmetrical axis of an opening at the end of the rectangular waveguides connected to the circular waveguide is parallel to the axis of the circular waveguide, thereby avoiding interfering with the propagation of $TM_{01}$ mode. In an application, the isolated dual-mode converter outputs $TE_{01}$ mode and $TM_{01}$ mode at the same port, thereby achieving more uniform microwave heating. In another application, two isolated dual-mode converters are aligned face-to-face, forming a dual-channel joint with high channel isolation and low transmission loss, which may be used for a rotary joint of a radar system.

21 Claims, 6 Drawing Sheets

ISOLATED DUAL-MODE CONVERTER AND APPLICATIONS THEREOF

BACKGROUND OF THE INVENTION

1. Field of the Invention

The present invention is related to a mode converter for microwave, and more particularly to an isolated dual-mode converter and applications thereof.

2. Description of the Prior Art

A mode converter converts a microwave in a mode to a microwave in another mode. For example, for an application in microwave heating, such as plasma heating or material processing, the mode converter can convert an asymmetrical mode into a symmetrical mode, so as to provide more uniform microwave heating. For an application in a rotary joint of a radar system or satellite system, the mode converter converts a commonly used transmission mode into a mode which is not affected by rotation or vice versa. Such mode converter should transmit the mode unaffected by rotation with almost no loss.

Prior art mode converters for microwave heating are single-mode converters. In such way, even the converted mode is of circular symmetry, the uniformity of the electric field intensity of a single mode is still limited. Generally speaking, a rotary joint may include single-mode converters for single-channel transmission, or dual-mode converters for dual-channel transmission. However, prior art mode converters for rotary joint typically include a complicated converting structure, such as the Marie transducer.

Therefore, a dual-mode converter that provides more uniform electric field intensity distribution and has a simpler structure is highly desirable.

SUMMARY OF THE INVENTION

The present invention is directed to providing an isolated dual-mode converter which includes two structures each exciting a mode, and the two structures causes only a minimal loss to each other. A property of the two modes excited is that their electric field intensity distributions are complement to each other, and when the two modes are output at the same port, the output energy is more uniform on the average of time. Another property of the two modes excited is that they are orthogonal to each other, and thus do not interfere with the propagation of each other, providing high isolation.

According to an embodiment, the isolated dual-mode converter includes a first waveguide element and a second waveguide element. The first waveguide element comprises a circular waveguide and N rectangular waveguides. The N rectangular waveguides each has a first end and a second end. The first ends of the N rectangular waveguides are connected to a side surface of the circular waveguide in a manner such that the N rectangular waveguides are arranged evenly and radially and a symmetrical axis of an opening at the first end is arranged parallel to the axis of the circular waveguide. The second ends of the N rectangular waveguides become at least a first in/out port, wherein N is an integer greater than 1. The second waveguide element comprises an outer conductor, an inner conductor, and an insulating filler disposed between the two. The internal wall of the outer conductor and the external wall of the inner conductor define a coaxial waveguide. The second waveguide element is connected to the first waveguide element in a manner such that an end of the coaxial waveguide is aligned axially and connected with an end of the circular waveguide, the other end of the coaxial waveguide is a second in/out port and the other end of the circular waveguide is a third in/out port.

According to an embodiment, a dual-channel joint comprises two aforementioned isolated dual-mode converters, wherein the third in/out port of the two isolated dual-mode converters are arranged facing and aligned axially with each other.

The objective, technologies, features and advantages of the present invention will become more apparent from the following description in conjunction with the accompanying drawings, wherein certain embodiments of the present invention are set forth by way of illustration and examples.

DESCRIPTION OF THE PREFERRED EMBODIMENT

According to an embodiment, the isolated dual-mode converter excites two modes with orthogonal electric fields and orthogonal magnetic fields. The two modes can be but not limited to $TE_{01}$ mode and $TE_{10}$ mode. When $TE_{01}$ mode or $TM_{01}$ mode is transmitted in a circular waveguide, the electric field E at any location can be separated into three components, which are $E_r$, representing the component in the radial direction of the circular waveguide; $E_\theta$, representing the component in the direction that circles the axis of the circular waveguide; and $E_z$, representing the component in the axial direction of the circular waveguide. Derived from the Helmholtz equation, the electric field pattern of $TE_{01}$ mode only has the $E_\theta$ component, and the electric field pattern of $TM_{01}$ mode only has the $E_r$ and $E_z$ components. Since the direction of $E_\theta$, $E_r$ and $E_z$ are orthogonal to each other, the electric field of $TE_{01}$ mode and $TM_{01}$ mode are orthogonal to each other. The same derivation also shows that the magnetic field of $TE_{01}$ mode and $TM_{01}$ mode are orthogonal to each other. Therefore, $TE_{01}$ mode and $TM_{01}$ mode do not affect the propagation of each other and have the property of being highly isolated.

Figure 1:
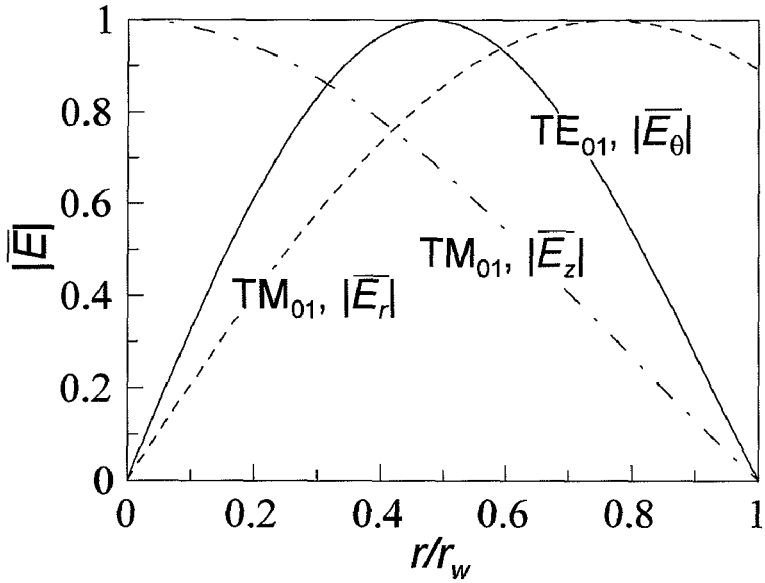
FIG. 1 is a diagram illustrating the relationship between the electric field intensity $|\bar{E}|$ and the distance $r/r_w$ between the location of the electric field intensity and the axis of the circular wave guide.

Another property of $TE_{01}$ mode and $TM_{01}$ mode is the electric field intensity distribution of the two modes are complementary to each other along the radius of the circular waveguide. FIG. 1 is a diagram illustrating the relationship between the electric field intensity $|\overline{E}|$ and the distance $r/r_w$ between the location of the electric field intensity and the axis of the circular waveguide, wherein $|\overline{E}|$ is the electric field intensity of a electric field component at a special location normalized against the largest electric field intensity of the component, and $r/r_w$ is the distance r between the special location of the electric field component and the axis of the circular waveguide normalized with the radius $r_w$ of the circular waveguide. As shown in FIG. 1, the electric field intensity $|\overline{E_z}|$ of $TM_{01}$ mode peaks at the axis of the circular waveguide and decreases gradually outward; the electric field intensity $|\overline{E_r}|$ of $TM_{01}$ mode peaks at about the circumference of the circular waveguide and decreases gradually inward; the electric field intensity $|\overline{E_\theta}$ of $TE_{01}$ mode peaks between the peak of $|\overline{E_z}|$ and $|\overline{E_r}|$ and decreases gradually towards the two sides. Therefore, the electric field intensity distribution of $TE_{01}$ mode and $TM_{01}$ mode are complementary along the radius of the circular waveguide, and such property allows the two modes to provide more uniform output energy on the average of time.

Figure 2:
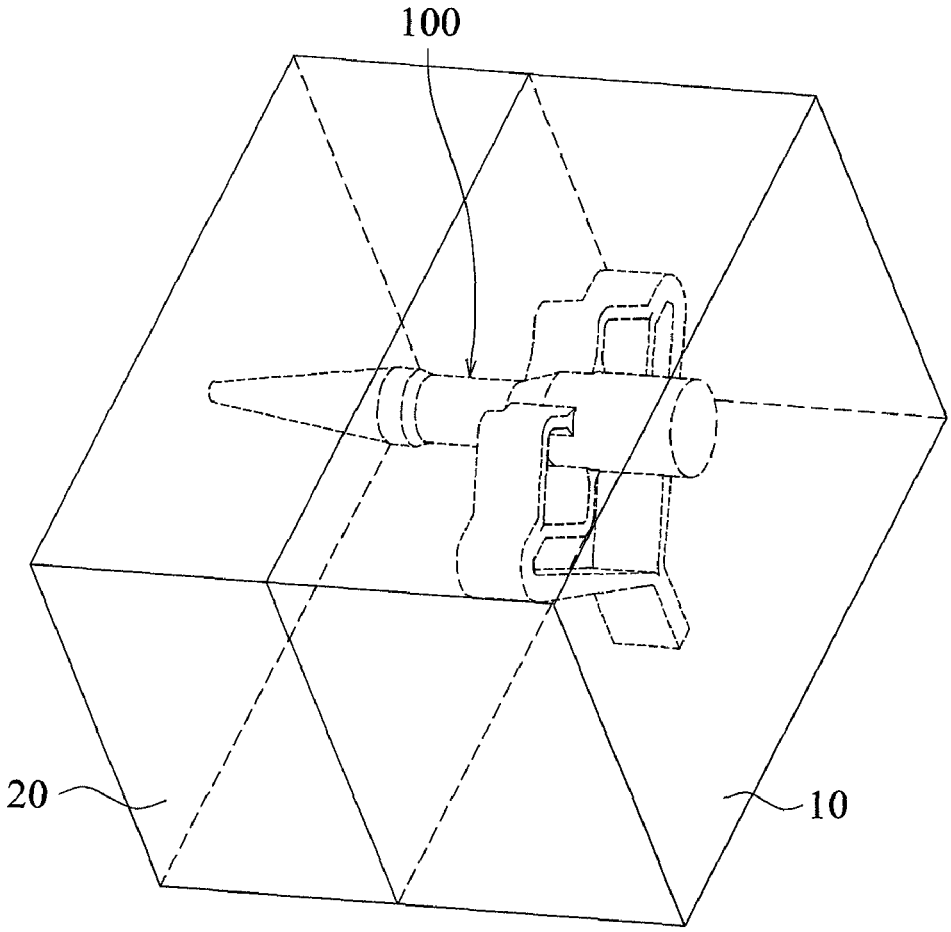
FIG. 2 is a perspective diagram schematically illustrating the structure of the isolated dual-mode converter according to an embodiment.
Figure 3:
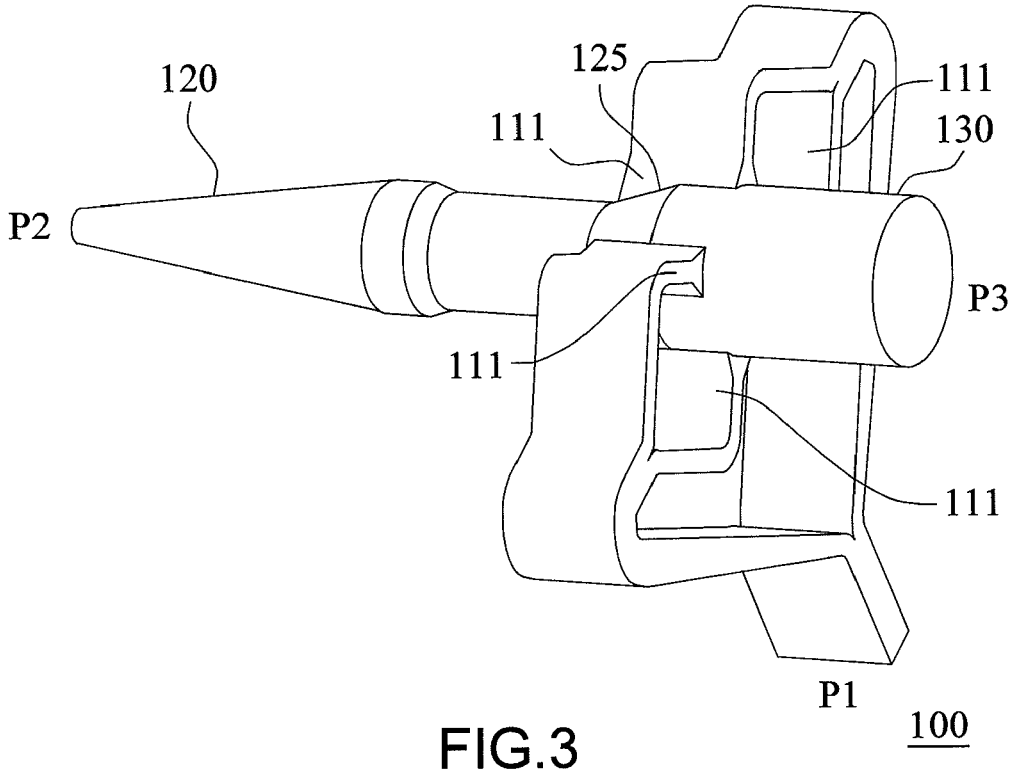
FIG. 3 is a side-view diagram schematically illustrating the structure of the waveguide of the isolated dual-mode converter according to an embodiment.

FIG. 2 is a perspective diagram schematically illustrating the structure of the isolated dual-mode converter according to an embodiment. FIG. 3 is a side-view diagram schematically illustrating the structure of the waveguide of the isolated dual-mode converter according to an embodiment. As shown in FIG. 2, the isolated dual-mode converter includes a first waveguide element 10 and a second waveguide element 20, wherein the hollow portion (shown with dashed line) is the waveguide portion 100 of the isolated dual-mode converter. As shown in FIG. 3, the waveguide portion 100 of the isolated dual-mode converter comprises a circular waveguide 130, N rectangular waveguides 111, and a coaxial waveguide 120. Each of the N rectangular waveguides has a first end and a second end. Of the N rectangular waveguides, the first ends are connected to the circumference of the circular waveguide 130, and the second ends become at least a first in/out port P1. Of the coaxial waveguide 120, an end is a second in/out port P2, and the other end is aligned axially and connected with an end of the circular waveguide 130. The other end of the circular waveguide 130 is the third in/out port P3. It is noted that although the waveguide portion 100 of the isolated dual-mode converter of the embodiment shown in FIG. 3 is formed by assembling the first waveguide element 10 including the circular waveguide 130 and N rectangular waveguides 111, and a second waveguide element 20 including the coaxial waveguide 120, other ways of assembling are possible.

Referring to FIG. 3, in an embodiment, the first in/out port P1 is for inputting or outputting a first mode which has a rectangular electric field pattern. The first mode can be but not limited to $TE_{10}$ mode. The second in/out port P2 is for inputting or outputting a second mode which has a surface current in axial direction on the coaxial waveguide 120. The second mode can be but not limited to TEM mode. The third in/out port P3 is for inputting or outputting a third mode which has a surface current in azimuthal direction on the circular waveguide 130 and/or a fourth mode which has a surface current in axial direction on the circular waveguide 130. The third mode can be but not limited to be $TE_{01}$ mode. The fourth mode can be but not limited to be $TM_{01}$ mode. For convenience of description, $TE_{10}$ mode, TEM mode, $TE_{01}$ mode and $TM_{01}$ mode are used to respectively represent the first mode, the second mode, the third mode and the fourth mode in the following.

Figure 4A:
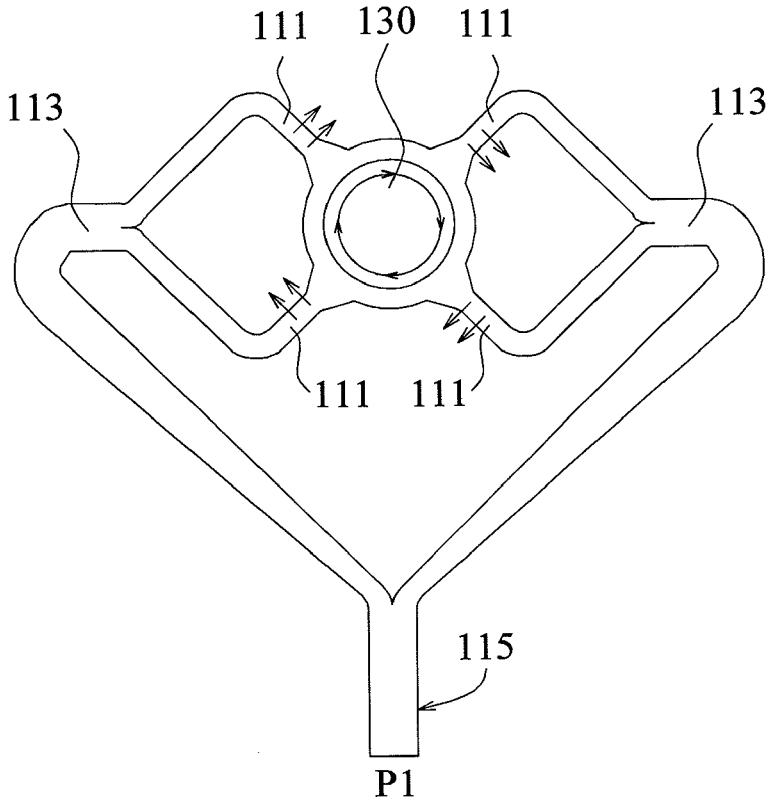
FIG. 4*a* is a cross-sectional diagram schematically illustrating a portion of the waveguide in FIG. 3.

The isolated dual-mode converter shown in FIG. 3 includes a $TE_{01}$ mode converter and a $TM_{01}$ mode converter. FIG. 4*a* is a cross-sectional diagram schematically illustrating a portion of the waveguide in FIG. 3. The cross-structural line is perpendicular to the axis of the circular waveguide. The portion of the waveguide shown in FIG. 4*a* is the $TE_{01}$ mode converter. It includes the circular waveguide 130, and the N rectangular waveguides 111 connected around the circumference of the circular waveguide 130, where N is an integer greater than 1. The N rectangular waveguides 111 are distributed evenly and radially around the circumference of the circular waveguide 130 and respectively provides the mode the electric field of which is orthogonal to the axial direction of the circular waveguide, such as but not limited to $TE_{10}$ mode. By doing so, the electric field direction of the mode supplied by the rectangular waveguides 111 around the circular waveguide are in clock wise direction or counter clock wise direction. Then, by having the mode provided by each rectangular waveguide to have the same energy and phase, $TE_{01}$ mode with circular electric field pattern can be excited in the circular waveguide 130.

In a preferred embodiment as shown in FIG. 4*a*, in order for the N rectangular waveguides 111 to provide $TE_{10}$ mode having the same energy and phase, the number of the rectangular waveguides N is arranged to be $2^n$, and every two neighboring rectangular waveguides 111 are merged into another rectangular waveguide 113, and then every two neighboring rectangular waveguides 113 are merged and so on, wherein n is a positive integer. Such Y structure forming process is continued until reaching an end of a main rectangular wave guide 115. The other end of the main rectangular waveguide 115 then becomes the first in/out port P1. According to an embodiment, the rectangular waveguides 111,113 are merged by arranging two rectangular waveguides 111,113 along the short side of the opening of the rectangular waveguide 113, 115.

Figure 4B:
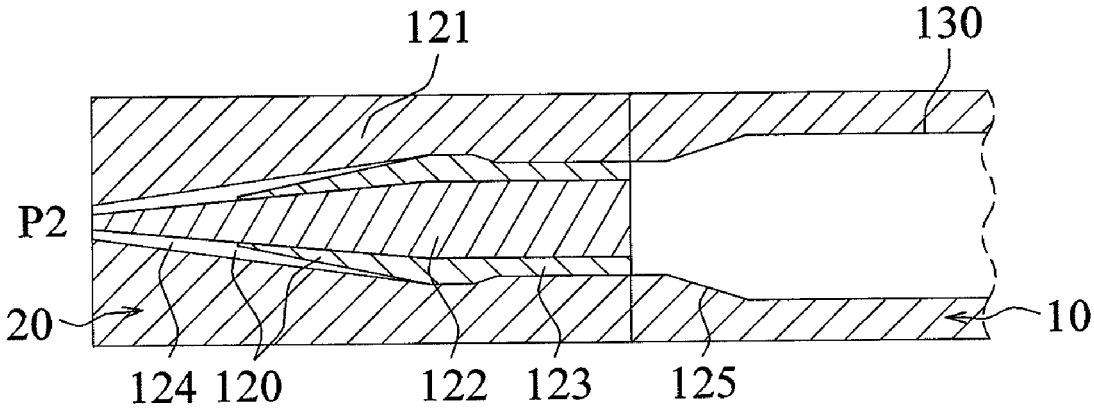
FIG. 4*b* is a cross-sectional diagram schematically illustrating a portion of the waveguide in FIG. 3.

FIG. 4*b* is a cross-sectional diagram schematically illustrating a portion of the waveguide in FIG. 3. The portion of the waveguide shown in FIG. 4*b* is the $TM_{01}$ mode converter. For clarity, the waveguide element (i.e. the conductor portion) is also shown. As shown in FIG. 4*b*, the $TM_{01}$ mode converter includes the coaxial waveguide 120 and the circular waveguide 130 aligned axially and connected with the coaxial waveguide 120. The second waveguide element 20 includes an outer conductor 121 and an inner conductor 122, and an insulating filler 123 filling between the two to support the inner conductor 122. The coaxial waveguide 120 is defined by the internal wall of the outer conductor 121 and the external wall of the inner conductor 122. According to an embodiment, the insulating filler 123 includes polytetrafluoroethylene (PTFE). In addition, according to an embodiment, the coaxial waveguide 120 includes a first gentle-sloped structure 124 such that the inner radius and the outer radius of the coaxial waveguide 120 gradually decreases toward the second in/out port P2, which then connects to a coaxial adapter (not shown) to connect with a standard coaxial cable. It has to be mentioned that FIG. 4*b* is for illustrating the $TM_{01}$ mode converter, and therefore the rectangular waveguides 111 of the first waveguide element 10 in FIG. 3 are not shown.

According to an embodiment in reference to FIG. 4*b*, $TM_{01}$ mode is excited by inputting TEM mode to the second in/out port P2. Because the surface current of TEM mode on the coaxial waveguide 120 is in axial direction, and the surface current of the $TM_{01}$ mode on the circular waveguide 130 is also in axial direction, TEM mode can be used to excite $TM_{01}$ mode. In addition, according to an embodiment, in order for an isolated dual-mode converter to be applied to high frequency microwave, such as W-band and Ka-band, the size of the isolated dual-mode converter made has to be extremely small. As a result, the inner conductor 122 includes a harder material such as brass instead of oxygen-free copper that causes smaller loss of TEM mode.

Figure 4C:
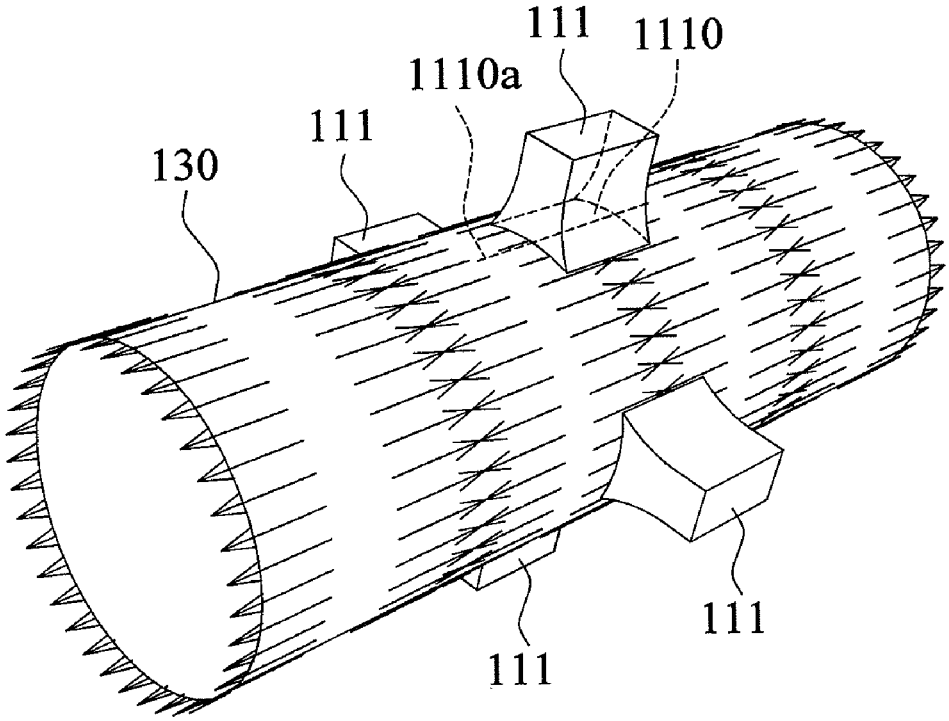
FIG. 4*c* is a side-view diagram schematically illustrating a portion of the waveguide in FIG. 3.

Referring to FIG. 3, the isolated dual-mode converter as discussed above can simultaneously excite $TE_{01}$ mode and $TM_{01}$ mode. In the following, the effect of the rectangular waveguide of the $TE_{01}$ mode converter on $TM_{01}$ mode is discussed. FIG. 4*c* is a side-view diagram schematically illustrating a portion of the waveguide in FIG. 3. The circular waveguide 130 in FIG. 4*c* is represented schematically by a cylinder, and the arrows on the circular waveguide 130 represent the surface current of $TM_{01}$ mode. According to an embodiment in reference to FIG. 4*c*, an opening 1110 at the first end of the rectangular waveguide 111 is connected to the side surface of the circular waveguide 130 and a symmetrical axis 1110*a* of the opening 1110 is arranged parallel to the axis of the circular waveguide 130, and therefore the opening 1110 would not cut off the surface current of $TM_{01}$ mode. According to an embodiment, the opening 1110 has a bar shape and the symmetrical axis 1110*a* is the long axis of the opening 1110. It is noted that shape of the opening 1110 of the rectangular waveguide 111 is not limited to be a rectangle. Any shape of square symmetry would suffice. In a different embodiment, the isolated dual-mode converter further includes a plurality of conductive sheets (not shown) respectively covering the opening 1110 at the first ends of the N rectangular waveguides 111. Each of the conductive sheets has a bar-shape coupling hole of square symmetry, and the long axis of the coupling hole is parallel to the axis of the circular waveguide 130.

According to an embodiment in reference to FIG. 3 and FIG. 4*b*, in order to have the excited $TE_{01}$ mode and $TM_{01}$ mode to operate in the same frequency range, the radius of the circular waveguide 130 is larger than that of the coaxial waveguide 120. Also, in this embodiment, in order to reduce reflection, the waveguide portion 100 of the isolated dual mode converter further includes a gentle-sloped structure 125 disposed between the coaxial waveguide 120 and the circular waveguide 130, according to an embodiment. The gentle-sloped structure 125 is hallow, and the radius of the end of the second gentle-sloped structure 125 interfacing with the circular waveguide 130 is larger than that interfacing with the coaxial waveguide 120. It is noted that radius of the end of the second gentle-sloped structure 125 connected with the coaxial waveguide 120 can be but not limited to be the same as the radius of the coaxial waveguide 120. Moreover, according to an embodiment, the N rectangular waveguides 111 are connected at the second gentle-sloped structure 125, so as to eliminate the resonance effect formed between the second gentle-sloped structure 125 and the opening 1110 (shown in FIG. 4*c*) of the rectangular waveguides 111, thereby improving the quality of the excited $TE_{01}$ mode.

Figure 5:
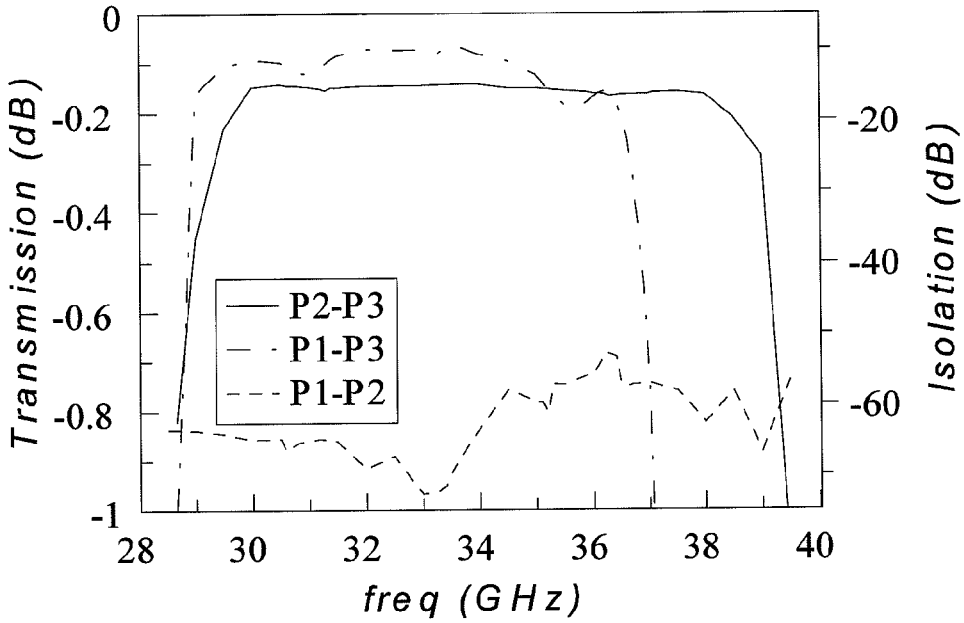
FIG. 5 is a diagram illustrating the relationship of the simulated transmission and isolation of the isolated dual-mode converter according to an embodiment with respect to operating frequency.

FIG. 5 is a diagram illustrating the relationship of the simulated transmission and isolation of the isolated dual-mode converter according to an embodiment with respect to operating frequency. The transmission is defined to be the output power of an in/out port divided by the input power of a corresponding in/out port. The isolation is defined to be the output power of an in/out port divided by the input power of a non-corresponding in/out port. In an application for the isolated dual mode converter, the first in/out port P1 receives $TE_{10}$ mode, the second in/out port P2 receives TEM mode, and the third in/out port P3 outputs both $TE_{01}$ mode and $TM_{01}$ mode. FIG. 5 shows the transmission of P1-P3, the transmission of P2-P3, and the isolation of P1-P2, wherein the transmission corresponds to the scale on the left while the isolation corresponds to the scale on the right. As shown in FIG. 5, in the operating frequency range 28.5 GHz-37 GHz, the transmission of P1-P3 and the transmission of P2-P3 are both maintained to be larger than −0.2 dB, and the isolation of P1-P2 is maintained to be less than −50 dB. The simulation result of transmission shows that the output power is very close to the input power, and therefore the loss caused by converting $TE_{10}$ mode into $TE_{01}$ mode (P1-P3) and converting TEM mode into $TM_{01}$ mode (P2-P3) is very low. The simulation result of isolation indicates the output power is extremely smaller than the input power, and thus the effect of the rectangular waveguide of the $TE_{01}$ mode converter on $TM_{01}$ mode (P2-P1) is minimal. In brief, the simulation result shows the isolated dual-mode converter can perform a low loss conversion of the input energy into $TE_{01}$ mode and $TM_{01}$ mode commonly output at the third in/out port, so that the output energy is more uniform on the average of time. Such advantage can be exploited when the isolated dual-mode converter is applied to microwave heating, such as plasma heating and material processing.

In another application, the isolated dual-mode converter of the present invention can also perform a $TE_{01}$ mode to $TE_{10}$ mode conversion (P3-P1), and a $TM_{01}$ mode to TEM mode conversion (P3-P2). When two isolated dual-mode converter are aligned face-to-face, a dual-channel joint is formed, which can be applied to a radar system or a satellite system, as discussed below.

Figure 6:
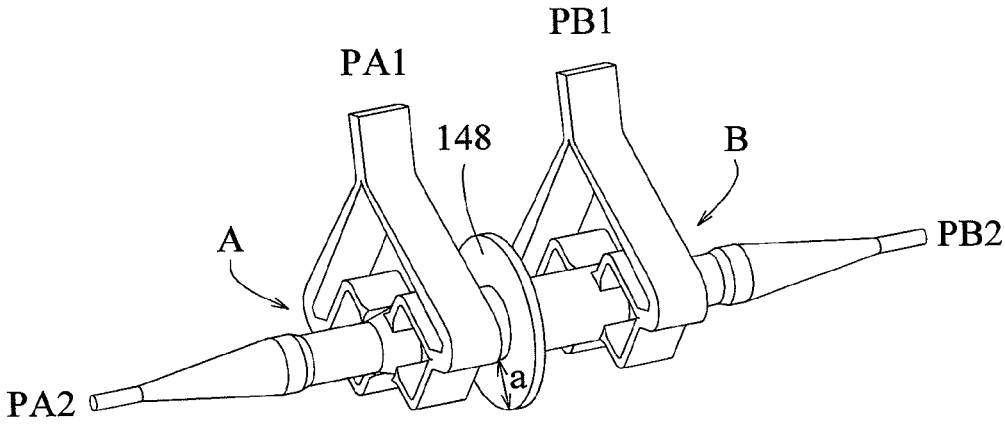
FIG. 6 is a side-view diagram schematically illustrating the structure of the waveguide of the dual-channel joint according to an embodiment.

FIG. 6 is a side-view diagram schematically illustrating the structure of the waveguide of the dual-channel joint according to an embodiment. According to an embodiment in reference to FIG. 6, a dual-channel joint includes two of the aforementioned isolated dual mode converters A, B, arranged in a manner such that their third in/out ports (not indicated) are facing and aligned axially with each other. In the present embodiment, a first channel of the dual-channel joint can be illustrated by the following process. The dual-mode converter A receives $TE_{10}$ mode from the first in/out port PA1, converts $TE_{10}$ mode into $TE_{01}$ mode, and then transmits $TE_{01}$ mode to the isolated dual-mode converter B. The isolated dual-mode converter B then converts $TE_{01}$ mode back to $TE_{10}$ mode and outputs $TE_{01}$ mode at the first in/out port PB1. The direction of the first channel here can be reversed. The second channel of dual-channel joint can be illustrated by the process below. The second in/out port PA2 of the isolated dual-mode converter A receives TEM mode, converts TEM mode into $TM_{01}$ mode and then transmits $TM_{01}$ mode to the isolated dual-mode converter B. The isolated dual-mode converter B then converts $TM_{01}$ mode back into TEM mode and outputs at the second in/out port PB2. The direction of the second channel here can be reversed.

Figure 7:
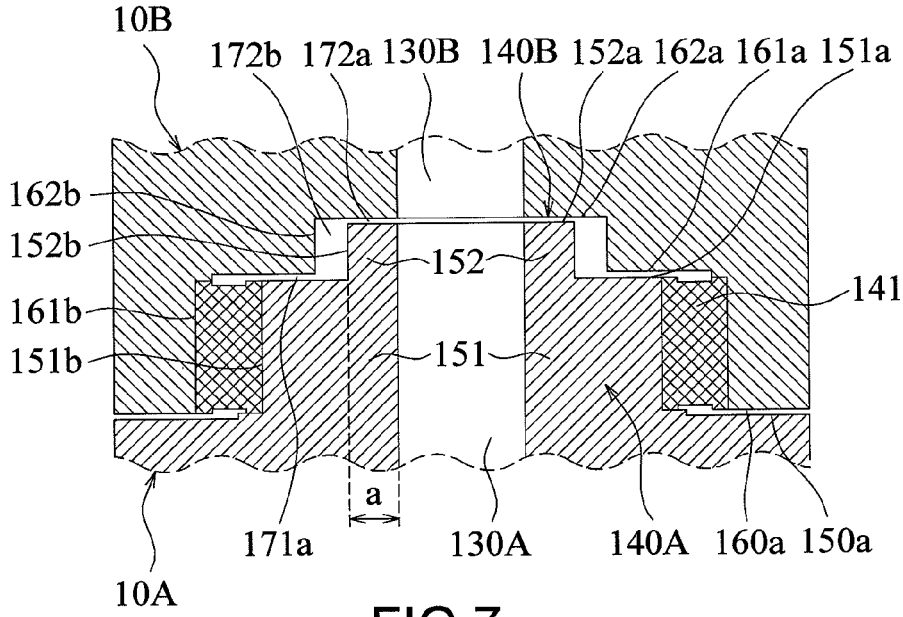
FIG. 7 is a cross-sectional diagram schematically illustrating the rotatable joint structure according to an embodiment of the dual-channel joint.

Generally speaking, a rotary joint of a radar system or a satellite system has 360° transmission and reception capability. By adding a rotatable joint structure between the two aforementioned isolated dual-mode converters A, B of the dual-channel joint, the two isolated dual mode converters A, B can rotate with respect to each other, thereby forming a rotary joint. One of the isolated dual-mode converters A may connect with the rotating end of the radar system and the other of the isolated dual-mode converter B may connect with the fixed end of the radar system. FIG. 7 is a cross-sectional diagram schematically illustrating the rotatable joint structure according to an embodiment of the dual-channel joint. As shown in FIG. 7, the rotatable joint structure includes a rotating head 140A disposed on the first waveguide element 10A of one of the isolated dual mode converter A, and a socket 140B disposed on the first waveguide element 10B of the other of the isolated dual mode converter B. In a different embodiment, the rotating head 140A and the socket 140B can be made as independent elements to be connected respectively with the first waveguide elements 10A and 10B by means of assembly.

In the present embodiment in reference to FIG. 7, the rotating head 140A and the socket 140B are respectively the protruded part of the rotatable joint structure and the corresponding indented part of the rotatable joint structure accommodating the protruded part of the rotatable joint structure. The circular waveguide 130A of the first waveguide element 10A pass through the rotating head 140A, and the circular waveguide 130B of the first waveguide element 10B of the isolated dual mode converter B pass through the socket 140B. According to the present embodiment, the circular waveguides 130A, 130B of the isolated dual mode converters A, B are arranged face-to-face and are aligned axially.

According to an embodiment in reference to FIG. 7, the surface of the rotating head 140A forms a stair-shape protrusion, and the surface of the socket 140B corresponding to the surface of the rotating head 140A forms a stair-shape indentation. For convenience of description, the surface perpendicular and the surface parallel to the axis of the circular waveguide 130A, 130B are respectively referred to as the first surface and the second surface. The stair-shape protrusion forming surface of the rotating head 140A includes a first surface 150*a* forming a bottom, a first surface 151*a* and a second surface 151*b* forming a first step 151, and a first surface 152*a* and a second surface 152*b* forming a second step 152, wherein the second surface 151*b*, 152*b* connects with the first surface 150*a*, 151*a* of the lower step. The stair-shape depression forming surface of the socket 140B includes a first surface 160 forming a top corresponding to the first surface 150*a* forming the bottom of the rotating head 140A, a first surface 161*a* and a second surface 161*b* respectively corresponding to the first surface 151*a* and the second surface 151*b* of the first step 151, and a first surface 162 and a second surface 162*b* respectively corresponding to the first surface 152*a* and the second surface 152*b* of the second step 152. According to the present embodiment, a gap is arranged between the corresponding surfaces facing against each other. Also, according to an embodiment, each step 151, 152 of the rotating head 140A are cylinders aligned axially and connected together, and a bearing is disposed between the second surface 151*b* of the first step 151 of the rotating head 140A, and corresponding second surface 161*b* of the socket 140B.

According to an embodiment in reference to FIG. 7, the rotatable joint structure is choke type, as discussed below. As described above, a gap is arranged between the rotating head 140A and the socket 140B, wherein the gap formed by the first surface 151*a*, 152*a* of the rotating head 140A and the corresponding first surface 161*a*, 162*a* of the socket 140B is referred to as the first gap 171*a*, 172*a*; and the gap formed by the second surface 152*b* of the rotating head 140A, and the corresponding second surface 162*b* of the socket 140B is referred to as the second gap 172*b*. The second gap 172*b* extends along the axial direction of the circular waveguide 130A, 130B towards the two sides and connects with the neighboring first gaps 171*a*, 172*a*. In the present embodiment, multiple reflections occur between the neighboring gaps is used to cause destructive interference at the inner end opening (connected to the circular waveguide 130A, 130B) of the first gap 172*a*, and therefore, the first gap 171*a*, 172*a* and the second gap 171*b* form a microwave choke reducing loss of $TM_{01}$ mode.

Figure 8:
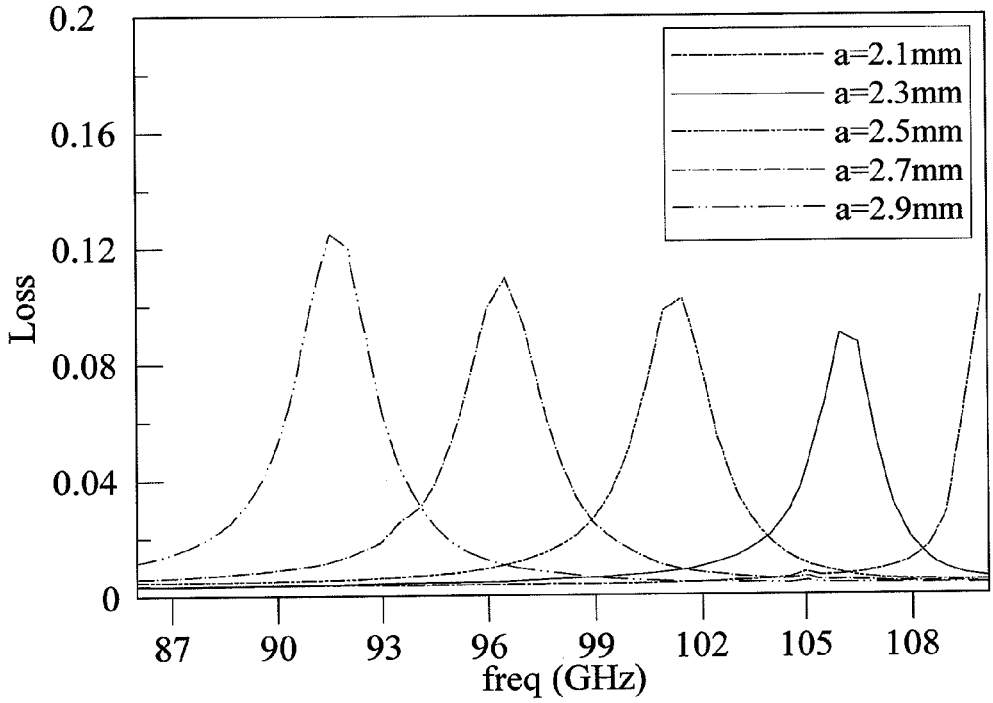
FIG. 8 is a diagram illustrating the relationship between the loss of $TM_{01}$ mode and the operating frequency under different distances a between the two interfaces.

Referring to FIG. 6 and FIG. 7, the first gap 172*a* includes two interfaces, respectively extends from the inner rim and outer rim of the first surface 152*a* of the second step 152 of the rotating head 140A, in a direction parallel to the axis of the circular waveguide 130A, 130B, to the corresponding first surface 162*a* of the socket 140B. The interface extended from the inner rim of the first interface 152*a* is connected with the gap between the circular waveguide 130A and the circular waveguide 130B; the interface extended from outer rim of the first interface 152*a* is connected to the second gap 172*b*. Since the first gap 172*a* is perpendicular to the axis of the circular waveguides 130A, 130B, it has a minimal effect on $TE_{01}$ mode having surface current in azimuthal direction but has a larger effect on $TM_{01}$ mode having surface current in axial direction. FIG. 8 is a diagram illustrating the relationship between the loss of $TM_{01}$ mode and the operating frequency under different distances a between the two interfaces. The distance a between the two interfaces is defined to be the difference between the outer radius and the inner radius of the first surface 152*a* of the second step 152 of the rotating head 140A. As shown in FIG. 8, when the operating frequency of the $TM_{01}$ mode causes resonance between the two interfaces separated by distance a, the loss of $TM_{01}$ mode is the highest, which is where the peak is located. Therefore, in an embodiment, in order to further reduce the loss of $TM_{01}$ mode, the distance a between the two interfaces is optimized in a manner such that $TM_{01}$ mode cannot reach resonance between the two interfaces. It is noted that for different operating frequencies, the distance a between the two interfaces that causes resonance is different, and therefore the distance a should be different for different operating frequencies.

Figure 9A:
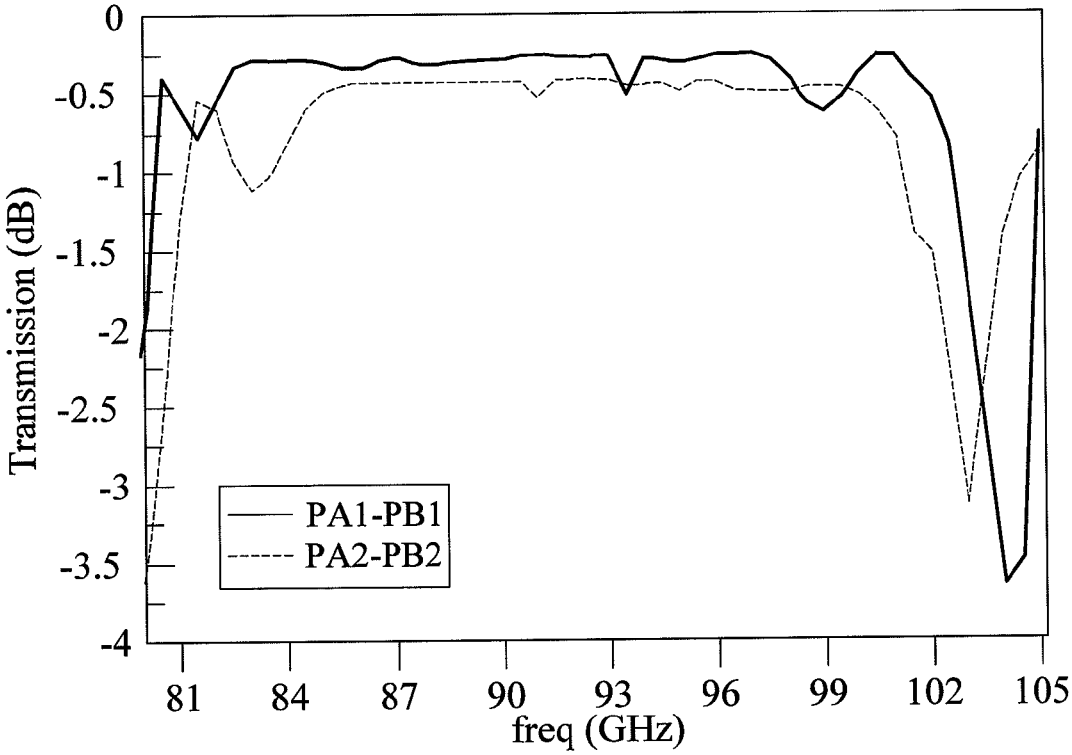
FIG. 9*a* and FIG. 9*b* are diagrams illustrating the relationship between transmission of the dual-channel joint and the operating frequency in W-band and Ka-band, respectively.
Figure 9B:
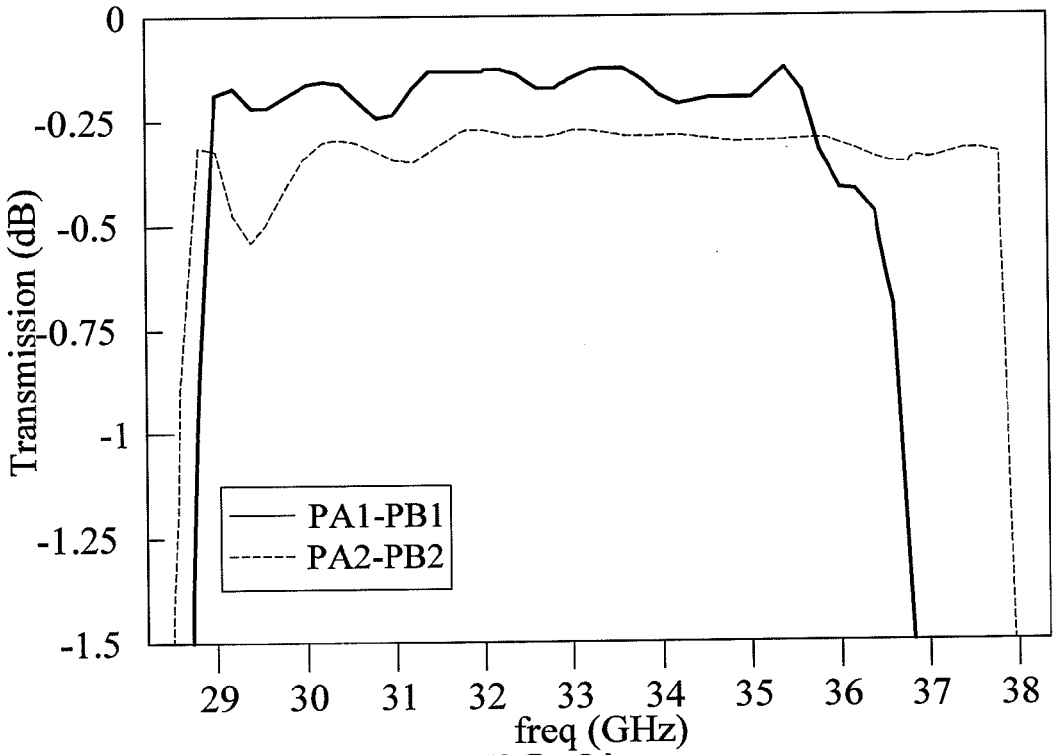

FIG. 9*a* and FIG. 9*b* are diagrams illustrating the relationship between transmission of the dual-channel joint and the operating frequency in W-band and Ka-band, respectively. Referring to FIG. 9*a*, FIG. 9*b* and FIG. 6, the solid line corresponds to the channel from the first in/out port PA1 of the isolated dual-mode converter A, to the first in/out port PB1 of the isolated dual-mode converter B (PA1-PB1), or vice versa; the dashed line corresponds to the channel from the second in/out port PA2 of the isolated dual-mode converter A to the second in/out port PB2 of the isolated dual-mode converter B, or vice versa. As shown in FIG. 9*a*, when the operating frequency is in W-band, the transmission of the two channels are mostly above −0.5 dB; and as shown in FIG. 9*b*, when the operating frequency is in Ka-band, the transmission of the two channels are mostly above −0.4 dB. Therefore, the simulation result shows that the dual-channel joint of the present embodiment provides two low loss channels respectively for transmitting two microwave signals. Also, because $TE_{01}$ and $TM_{01}$ mode are orthogonal to each other as discussed above, the two channels are highly isolated.

In conclusion, the present invention provides an isolated dual-mode converter which includes two structures each exciting a mode. The two modes excited are orthogonal to each other, and can be but not limited to $TE_{01}$ mode and $TM_{01}$ mode. One property of the two modes is that they are highly isolated, and another property of the two modes is that their electric field intensity distributions are complement to each other. Also, the $TE_{01}$ mode converter of the isolated dual-mode converter has a minimal effect on $TM_{01}$ mode. Therefore, in a application which outputs the two modes in the same in/out port, more uniform microwave heating on average of time is provided, which can be applied to plasma heating or material processing. In another application which aligns two isolated dual-mode converters face-to-face, a low loss and highly isolated dual-channel joint is formed, which can be applied to a rotary joint of a radar system or a satellite system.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. An isolated dual-mode converter comprising:

a first waveguide element comprising a circular waveguide, and N rectangular waveguides each having a first end being connected to a side surface of the circular waveguide in a manner such that the N rectangular waveguides are arranged evenly and radially, and a symmetrical axis of an opening at the first end are arranged parallel to the axis of the circular waveguide; and a second end, wherein the second ends of the N rectangular waveguides become at least a first in/out port and N is an integer greater than 1; and a second waveguide element comprising an outer conductor and an inner conductor defining a coaxial waveguide, and an insulating filler disposed therebetween, wherein the second waveguide element is connected with the first waveguide element in a manner such that an end of the coaxial waveguide is aligned axially and connected with an end of the circular waveguide, the other end of the coaxial waveguide is a second in/out port, and the other end of the circular waveguide is a third in/out port.

2. The isolated dual-mode converter according to claim 1, wherein the second end of the rectangular waveguides are merged to an end of a main rectangular waveguide, and the other end of the main rectangular waveguide is the first in/out port.

3. The isolated dual-mode converter according to claim 1, wherein the number of rectangular waveguides N is equal to $2^n$, and any two of the neighboring rectangular waveguides are merged into another of the rectangular waveguide, forming at least a Y structure, wherein n is a positive integer.

4. The isolated dual-mode converter according to claim 1, wherein the first in/out port is for inputting or outputting a first mode having a rectangular electric field pattern, the second in/out port is for inputting or outputting a second mode having a surface current in axial direction on the outer conductor, the third in/out port is for inputting or outputting a third mode having a surface current in azimuthal direction on the circular waveguide and/or a fourth mode having a surface current in axial direction on the circular waveguide.

5. The isolated dual-mode converter according to claim 4, wherein the first mode is $TE_{10}$ mode, the second mode is TEM mode, the third mode is $TE_{01}$ mode and the fourth mode is $TM_{01}$ mode.

6. The isolated dual-mode converter according to claim 1, wherein a shape of the opening at the first end of the rectangular waveguide is of square symmetry.

7. The isolated dual-mode converter according to claim 1, wherein the coaxial waveguide comprises a first gentle-sloped structure such that the inner radius and the outer radius of the coaxial waveguide decrease gradually towards the second in/out port.

8. The isolated dual-mode converter according to claim 1, further comprising a second gentle-sloped structure disposed between the coaxial waveguide and the circular waveguide, wherein the second gentle-sloped structure is hollow and the radius of the second gentle-sloped structure interfacing with the circular waveguide is larger than that of the second gentle-sloped structure interfacing with the coaxial waveguide.

9. The isolated dual-mode converter according to claim 1, wherein the insulating filler comprises polytetrafluoroethylene (PTFE).

10. A dual-channel joint comprising:

two isolated dual-mode converters, wherein the isolated dual-mode converter comprises:

a first waveguide element comprising a circular waveguide, and N rectangular waveguides each having a first end being connected to a side surface of the circular waveguide in a manner such that the N rectangular waveguides are arranged evenly and radially, and a symmetrical axis of an opening at the first end are arranged parallel to the axis of the circular waveguide; and a second end, wherein the second ends of the N rectangular waveguides become at least a first in/out port, and N is an integer greater than 1; and a second waveguide element comprising an outer conductor and an inner conductor defining a coaxial waveguide, and an insulating filler disposed therebetween, wherein the second waveguide element is connected to the first waveguide element in a manner such that an end of the coaxial waveguide is aligned axially and connected with an end of the circular waveguide, the other end of the coaxial waveguide is a second in/out port and the other end of the circular waveguide is a third in/out port, wherein:

the third in/out port of the two isolated dual-mode converters are arranged facing and aligned axially with each other.

11. The dual-channel joint according to claim 10, wherein the second ends of the rectangular waveguides are merged to an end of a main rectangular waveguide, and the other end of the main rectangular waveguide is the first in/out port.

12. The dual-channel joint according to claim 10, wherein the number of rectangular waveguides N is equal to $2^n$, and any two of the neighboring rectangular waveguides are merged into another of the rectangular waveguide, forming at least a Y structure, wherein n is a positive integer.

13. The dual-channel joint according to claim 10, wherein the first in/out port is for inputting or outputting a first mode having a rectangular electric field pattern, the second in/out port is for inputting or outputting a second mode having a surface current in axial direction on the outer conductor, the third in/out port is for inputting or outputting a third mode having a surface current in azimuthal direction on the circular waveguide and/or a fourth mode having a surface current in axial direction on the circular waveguide.

14. The dual-channel joint according to claim 13, wherein the first mode is $TE_{10}$ mode, the second mode is TEM mode, the third mode is $TE_{10}$ mode and the fourth mode is $TM_{10}$ mode.

15. The dual-channel joint according to claim 10, wherein a the shape of the opening at the first end of the rectangular waveguide is of square symmetry.

16. The dual-channel joint according to claim 10, further comprises a rotatable joint structure disposed between the two isolated dual-mode converters for the isolated dual-mode converters to rotate relatively with respect to each other.

17. The dual-channel joint according to claim 16, wherein the rotatable joint structure arranges the two isolated dual-mode converters to be separated by a first gap, wherein the first gap comprises two interfaces respectively located at the two ends of the first gap, and the two interfaces are separated by a distance such that the third mode cannot reach resonance.

18. The dual-channel joint according to claim 16, wherein the rotary joint structure is choke type.

19. The dual-channel joint according to claim 10, wherein the coaxial waveguide comprises a first gentle-sloped structure such that the inner radius and the outer radius of the coaxial waveguide decrease gradually towards the second in/out port.

20. The dual-channel joint according to claim 10, further comprising a second gentle-sloped structure disposed between the coaxial waveguide and the circular waveguide, wherein the second gentle-sloped structure is hollow and the radius of the second gentle-sloped structure interfacing with the circular waveguide is larger than that of the second gentle-sloped structure interfacing with the coaxial waveguide.

21. The dual-channel joint according to claim 10, wherein the insulating filler comprises polytetrafluoroethylene (PTFE).

* * * * *